US010008139B2

(12) United States Patent
Tang et al.

(10) Patent No.: US 10,008,139 B2
(45) Date of Patent: Jun. 26, 2018

(54) V-GATE LAYOUT AND GATE DRIVE CONFIGURATION

(71) Applicant: APPLE INC., Cupertino, CA (US)

(72) Inventors: Howard H. Tang, San Diego, CA (US); Wei Chen, Palo Alto, CA (US); Paolo Sacchetto, Cupertino, CA (US); Chaohao Wang, Sunnyvale, CA (US); Chun-Yao Huang, Cupertino, CA (US); Hao-Lin Chiu, Campbell, CA (US)

(73) Assignee: APPLE INC., Cupertino, CA (US)

( * ) Notice: Subject to any disclaimer, the term of this patent is extended or adjusted under 35 U.S.C. 154(b) by 113 days.

(21) Appl. No.: 14/995,796

(22) Filed: Jan. 14, 2016

(65) Prior Publication Data

US 2017/0061837 A1 Mar. 2, 2017

Related U.S. Application Data

(60) Provisional application No. 62/209,744, filed on Aug. 25, 2015.

(51) Int. Cl.

| | |
|---|---|
| ***G09G 3/36*** | (2006.01) |
| ***G09G 3/00*** | (2006.01) |
| ***G09G 3/20*** | (2006.01) |

(52) U.S. Cl.

CPC ..... *G09G 3/00* (2013.01); *G09G 3/20* (2013.01); *G09G 2300/0426* (2013.01); *G09G 2310/0218* (2013.01); *G09G 2310/0278* (2013.01); *G09G 2310/0281* (2013.01); *G09G 2320/0209* (2013.01); *G09G 2320/0219* (2013.01)

(58) Field of Classification Search

CPC . G06F 3/038; G09G 5/00; G09G 3/30; G09G 3/36; G11C 19/00; G02F 1/1345

See application file for complete search history.

(56) References Cited

U.S. PATENT DOCUMENTS

| | | | | |
|---|---|---|---|---|
| 7,289,096 | B2 | 10/2007 | Jeon et al. | |
| 8,232,946 | B2 | 7/2012 | Kim et al. | |
| 8,810,541 | B2 | 8/2014 | Yousefpor | |
| 8,890,853 | B2 | 11/2014 | Schuele et al. | |
| 9,075,483 | B2 | 7/2015 | Westerman et al. | |
| 2010/0066967 | A1* | 3/2010 | Takahashi | G02F 1/1345 349/143 |
| 2010/0128028 | A1* | 5/2010 | Lee | G09G 3/3677 345/214 |
| 2014/0152938 | A1* | 6/2014 | Lee | G09G 3/3648 349/46 |
| 2016/0203753 | A1* | 7/2016 | Hwang | G09G 3/2092 345/212 |

OTHER PUBLICATIONS

International Search Report and Written Opinion for PCT Application No. PCT/US2016/046362 dated Oct. 20, 016, 11 pgs.

* cited by examiner

*Primary Examiner* — Pegeman Karimi

(74) *Attorney, Agent, or Firm* — Fletcher Yoder PC

(57) ABSTRACT

A display device may include a plurality of pixels, a plurality of source lines that may provide a plurality of data line signals to the plurality of pixels, a plurality of gate lines that may provide a plurality of gate signals to a plurality of switches associated with the plurality of pixels, and a plurality of voltage gate lines disposed parallel to the plurality of source lines and coupled to the plurality of gate lines at a plurality of cross point nodes. The plurality of cross point nodes are positioned in a pseudo random order across the display device.

14 Claims, 14 Drawing Sheets

170

| Y - COORDINATE | BIT SEQUENCE | | | | | | | | | | | | X - COORDINATE |
|---|---|---|---|---|---|---|---|---|---|---|---|---|---|
| 0 | 0 | 0 | 0 | 0 | 0 | 0 | 0 | 0 | 0 | 0 | 0 | 0 | 0 |
| 1 | 1 | 0 | 0 | 0 | 0 | 0 | 0 | 0 | 0 | 0 | 0 | 0 | 1024 |
| 2 | 0 | 1 | 0 | 0 | 0 | 0 | 0 | 0 | 0 | 0 | 0 | 0 | 512 |
| 3 | 1 | 1 | 0 | 0 | 0 | 0 | 0 | 0 | 0 | 0 | 0 | 0 | 1236 |
| 4 | 0 | 0 | 1 | 0 | 0 | 0 | 0 | 0 | 0 | 0 | 0 | 0 | 256 |
| 5 | 1 | 0 | 1 | 0 | 0 | 0 | 0 | 0 | 0 | 0 | 0 | 0 | 1280 |
| 6 | 0 | 1 | 1 | 0 | 0 | 0 | 0 | 0 | 0 | 0 | 0 | 0 | 768 |
| 7 | 1 | 1 | 1 | 0 | 0 | 0 | 0 | 0 | 0 | 0 | 0 | 0 | 1792 |
| 8 | 0 | 0 | 0 | 1 | 0 | 0 | 0 | 0 | 0 | 0 | 0 | 0 | 128 |
| 9 | 1 | 0 | 0 | 1 | 0 | 0 | 0 | 0 | 0 | 0 | 0 | 0 | 1152 |
| 10 | 0 | 1 | 0 | 1 | 0 | 0 | 0 | 0 | 0 | 0 | 0 | 0 | 640 |
| 11 | 1 | 1 | 0 | 1 | 0 | 0 | 0 | 0 | 0 | 0 | 0 | 0 | 1664 |
| 12 | 0 | 0 | 1 | 1 | 0 | 0 | 0 | 0 | 0 | 0 | 0 | 0 | 384 |
| 13 | 1 | 0 | 1 | 1 | 0 | 0 | 0 | 0 | 0 | 0 | 0 | 0 | 1408 |
| 14 | 0 | 1 | 1 | 1 | 0 | 0 | 0 | 0 | 0 | 0 | 0 | 0 | 896 |
| 15 | 1 | 1 | 1 | 1 | 0 | 0 | 0 | 0 | 0 | 0 | 0 | 0 | 1920 |

*FIG. 12*

| LINE | A | B | C | D |
|---|---|---|---|---|
| 1 | 0 | 224 | 96 | 224 |
| 2 | 384 | 256 | 480 | 352 |
| 3 | 128 | 0 | 128 | 96 |
| 4 | 256 | 384 | 256 | 384 |
| 5 | 64 | 128 | 0 | 128 |
| 6 | 448 | 320 | 384 | 256 |
| 7 | 192 | 64 | 192 | 0 |
| 8 | 320 | 448 | 320 | 448 |
| 9 | 32 | 192 | 64 | 192 |
| 10 | 416 | 288 | 448 | 320 |
| 11 | 160 | 32 | 160 | 64 |
| 12 | 288 | 416 | 288 | 416 |
| 13 | 96 | 160 | 32 | 160 |
| 14 | 480 | 352 | 416 | 288 |
| 15 | 224 | 96 | 224 | 32 |
| 16 | 352 | 480 | 352 | 480 |

V-GATE LAYOUT AND GATE DRIVE CONFIGURATION

CROSS REFERENCE TO RELATED APPLICATIONS

This application is a Non-Provisional Patent Application of U.S. Provisional Patent Application No. 62/209,744, entitled "V-Gate Layout and Gate Drive Configuration", filed Aug. 25, 2015, which is herein incorporated by reference.

BACKGROUND

The present disclosure relates generally to electronic display devices that depict image data. More specifically, the present disclosure relates to systems and methods for digitally compensating for coupling effects that may be present in electronic display devices.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As electronic displays are employed in a variety of electronic devices, such as mobile phones, televisions, tablet computing devices, and the like, manufacturers of the electronic displays continuously seek ways to improve the design of the electronic display. For example, the size of a bezel region that surrounds a display panel of an electronic display has steadily decreased with improved circuitry in the electronic display. In some cases, however, the reduced bezel region may be accompanied with certain undesirable visual effects. As such, it is desirable to identify various systems and methods that may compensate for the undesirable visual effects that may be present on various electronic displays.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

An electronic display may reduce the size of its bezel region by employing certain electronic circuitry to drive the pixels of the electronic display. Often times, the circuitry of the electronic display may include a gate driver integrated circuit (IC) and a source driver IC (e.g., source driver IC). Generally, the gate driver IC couples voltages across gate lines that run in one direction (e.g., horizontally) across a display panel of the electronic display, while the source driver IC couples data line signals (e.g., gray level) to source lines that run in another direction (e.g., vertically) across the display panel. In combination, the gate driver IC and the source driver IC may illuminate pixels in the display panel to display desired image data that may be provided via a processor. In some instances, the gate driver IC may be may be placed on one side (e.g., along vertical edge) of the electronic display and the source driver IC may be placed on another side (e.g., along horizontal edge) of the electronic display to drive the gate lines and source lines, respectively.

To reduce the size of the bezel region surrounding the display panel, in one embodiment, the gate driver IC and the source driver IC may be co-located along one side of the electronic display. That is, the gate driver IC and the source driver IC may both be located adjacent to a horizontal edge or a vertical edge of the display panel. However, when placing both the gate driver IC and the source driver IC on the same side of the electronic display additional wiring will be provided in the display panel, such that the gate driver IC may couple to the appropriate gate lines. The additional wiring (e.g., voltage gate lines, v-gate lines) may be parallel to the source lines and may be coupled to gate lines that control the operation of a pixel. Each v-gate line may be coupled to each gate line at a cross point node. In certain embodiments, each cross point node may include some uniform space between each cross point node. That is, each cross point node may be located along some imaginary linear line that travels diagonally across the display. In this case, due to the proximity between the parallel v-gate lines and the source lines, the pixels located at the cross point nodes may experience a coupling effect that may alter voltage signals received by the respective pixels via the respective source lines due to the voltage signals present on the v-gate lines. As a result, the respective pixel value depicted at each respective pixel located near a cross point node may be less than the desired pixel value. This reduced pixel value may cause an undesirable line to be depicted on the display while presenting various image data.

With the foregoing in mind, in certain embodiments, to reduce the visibility of this undesired line, the cross point nodes may be positioned in a pseudo random manner across the display. When determining the positions of the cross point nodes, the pseudo random positions may be arranged such that all of the cross point nodes do not form a line or any noticeable shape in a given display panel size and resolution. That is, the cross point nodes will be selected to ensure that the nodes do not form a straight-line edge. Also, vertically adjacent cross points may be designed such that each respective vertically adjacent cross point is spaced a certain distance (e.g., horizontal distance) apart to minimize clusters of cross point nodes being located close to each other. Taking these design parameters into account, the cross point nodes may be positioned within the display in such a manner that undesired pixel values depicted by respective pixels may not be detectable to a viewer of the display. Additional details regarding the manner in which the cross point nodes is positioned and corresponding gate drive circuitry used to coordinate the display of image data via the cross point nodes will be discussed below.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which:

FIG. 12 is a sample chart that indicates potential grid locations for cross point nodes of the display in the electronic device of FIG. 1, in accordance with aspects of the present disclosure;

DETAILED DESCRIPTION

Figure 1:
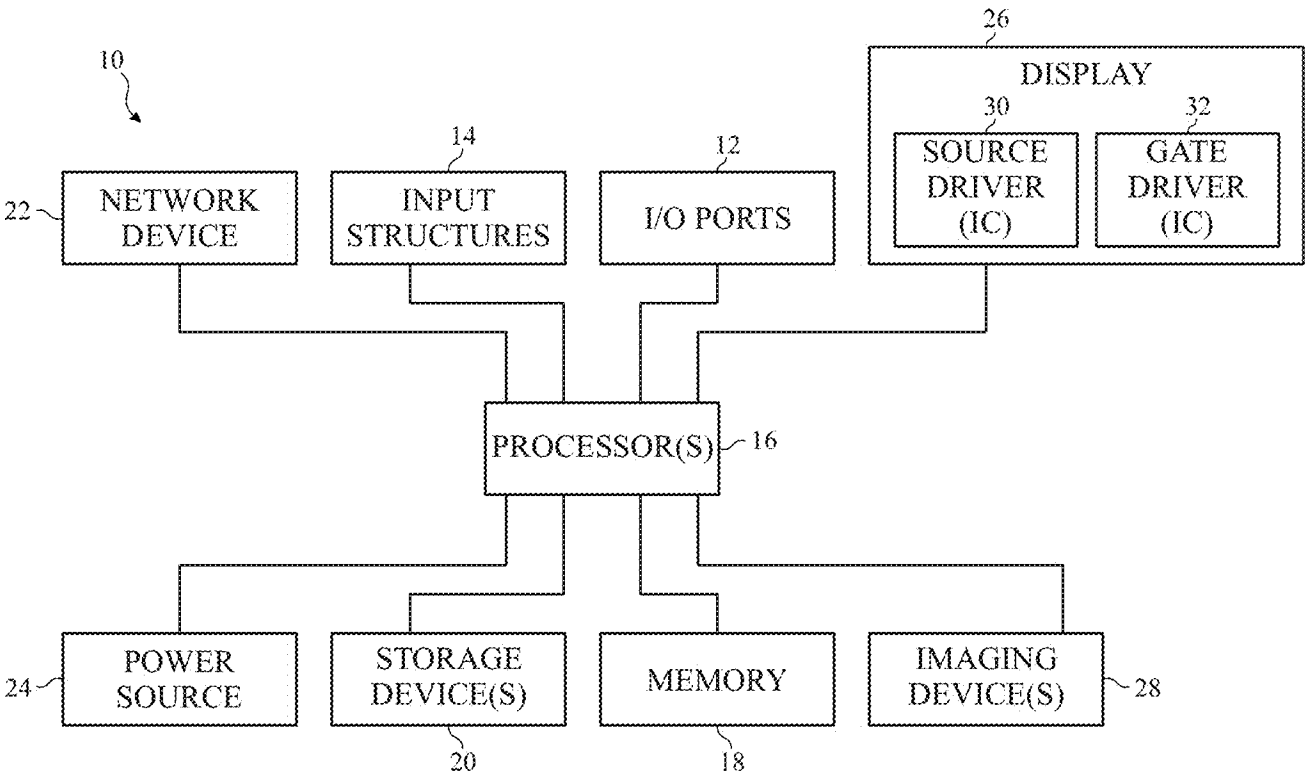
FIG. 1 is a simplified block diagram of components of an electronic device that may depict image data on a display, in accordance with embodiments described herein.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, in certain embodiments, a display of an electronic device may include cross point nodes positioned in a pseudo random arrangement across a display panel to compensate for the coupling effect that may be present on various pixels of the display panel. Generally, at or near a cross-point pixel where a voltage-gate line (v-gate line) couples to a gate line, a corresponding data line signal received via a source line parallel to the v-gate line at the cross-point pixel may experience a voltage kick back due to the coupling effect between the v-gate line and the source line. The voltage kick back may occur when the gate when the gate driver IC turns a corresponding gate at the cross-point pixel off (e.g., switches voltage from high to low) due to the coupling effect between the v-gate line and the source line. For example, when a voltage signal provided to a gate line via the v-gate line at a cross-point pixel changes from high to low, the voltage signal provided to the cross-point pixel via the source line may decrease due to the coupling effect. As a result, the pixel may depict a gray level illumination that is less than the desired gray level for the pixel as per the desired image data.

Since the pixels located at cross point nodes may experience a higher level of kickback as compared to other pixels in the display, in certain embodiments, the cross point nodes may be positioned in a pseudo random arrangement across the display. To facilitate this pseudo random arrangement, multiple gate driver ICs may provide gate voltages to different sections of the display. That is, depending on the size and the resolution of the display, a certain number of gate driver ICs may control how gate drive signals may be provided to different sections of the display, such that the images depicted on the display depict the desired image data as provided via a processor.

By way of introduction, FIG. 1 is a block diagram illustrating an example of an electronic device 10 that may include the gate driver and source driver circuitry mentioned above. The electronic device 10 may be any suitable electronic device, such as a laptop or desktop computer, a mobile phone, a digital media player, television, or the like. By way of example, the electronic device 10 may be a portable electronic device, such as a model of an iPod® or iPhone®, available from Apple Inc. of Cupertino, Calif. The electronic device 10 may be a desktop or notebook computer, such as a model of a MacBook®, MacBook® Pro, MacBook Air®, iMac®, Mac® Mini, or Mac Pro®, available from Apple Inc. In other embodiments, electronic device 10 may be a model of an electronic device from another manufacturer.

As shown in FIG. 1, the electronic device 10 may include various components. The functional blocks shown in FIG. 1 may represent hardware elements (including circuitry), software elements (including code stored on a computer-readable medium) or a combination of both hardware and software elements. In the example of FIG. 1, the electronic device 10 includes input/output (I/O) ports 12, input structures 14, one or more processors 16, a memory 18, nonvolatile storage 20, networking device 22, power source 24, display 26, and one or more imaging devices 28. It should be appreciated, however, that the components illustrated in FIG. 1 are provided only as an example. Other embodiments of the electronic device 10 may include more or fewer components. To provide one example, some embodiments of the electronic device 10 may not include the imaging device(s) 28.

Before continuing further, it should be noted that the system block diagram of the device 10 shown in FIG. 1 is intended to be a high-level control diagram depicting various components that may be included in such a device 10. That is, the connection lines between each individual component shown in FIG. 1 may not necessarily represent paths or directions through which data flows or is transmitted between various components of the device 10. Indeed, as discussed below, the depicted processor(s) 16 may, in some embodiments, include multiple processors, such as a main processor (e.g., CPU), and dedicated image and/or video processors. In such embodiments, the processing of image data may be primarily handled by these dedicated processors, thus effectively offloading such tasks from a main processor (CPU).

Considering each of the components of FIG. 1, the I/O ports 12 may represent ports to connect to a variety of devices, such as a power source, an audio output device, or other electronic devices. The input structures 14 may enable user input to the electronic device, and may include hardware keys, a touch-sensitive element of the display 26, and/or a microphone.

The processor(s) 16 may control the general operation of the device 10. For instance, the processor(s) 16 may execute an operating system, programs, user and application interfaces, and other functions of the electronic device 10. The processor(s) 16 may include one or more microprocessors and/or application-specific microprocessors (ASICs), or a combination of such processing components. For example, the processor(s) 16 may include one or more instruction set (e.g., RISC) processors, as well as graphics processors (GPU), video processors, audio processors and/or related chip sets. As may be appreciated, the processor(s) 16 may be coupled to one or more data buses for transferring data and instructions between various components of the device 10. In certain embodiments, the processor(s) 16 may provide the processing capability to execute an imaging applications on the electronic device 10, such as Photo Booth®, Aperture®, iPhoto®, Preview®, iMovie®, or Final Cut Pro® available from Apple Inc., or the "Camera" and/or "Photo" applications provided by Apple Inc. and available on some models of the iPhone®, iPod®, and iPad®.

A computer-readable medium, such as the memory 18 or the nonvolatile storage 20, may store the instructions or data to be processed by the processor(s) 16. The memory 18 may include any suitable memory device, such as random access memory (RAM) or read only memory (ROM). The nonvolatile storage 20 may include flash memory, a hard drive, or any other optical, magnetic, and/or solid-state storage media. The memory 18 and/or the nonvolatile storage 20 may store firmware, data files, image data, software programs and applications, and so forth.

The network device 22 may be a network controller or a network interface card (NIC), and may enable network communication over a local area network (LAN) (e.g., Wi-Fi), a personal area network (e.g., Bluetooth), and/or a wide area network (WAN) (e.g., a 3G or 4G data network). The power source 24 of the device 10 may include a Li-ion battery and/or a power supply unit (PSU) to draw power from an electrical outlet or an alternating-current (AC) power supply.

The display 26 may display various images generated by device 10, such as a GUI for an operating system or image data (including still images and video data). The display 26 may be any suitable type of display, such as a liquid crystal display (LCD), plasma display, or an organic light emitting diode (OLED) display, for example. Additionally, as mentioned above, the display 26 may include a touch-sensitive element that may represent an input structure 14 of the electronic device 10. The imaging device(s) 28 of the electronic device 10 may represent a digital camera that may acquire both still images and video. Each imaging device 28 may include a lens and an image sensor capture and convert light into electrical signals.

In certain embodiments, the display 26 may include a source driver integrated circuit (IC) 30 and a gate driver IC 32. The source driver IC 30 and the gate driver IC 32 may each be separate or integral to the display 26. The source driver IC 30 and the gate driver IC 32 may include a chip, such as processor or ASIC, that may control various aspects of the display 26. For instance, the source driver IC 30 may receive image data from the processor 16 and send corresponding image signals to pixels that are part of the display 26 via source lines of the display 26. As such, the source driver IC 30 may enable the display 26 to depict images that correspond to the image data. To depict the images, the source driver IC 30 may send a digital level value to each image pixel of the display 26 via the source lines. The digital level value typically represents a shade of darkness or brightness between black and white and may be commonly referred to as gray levels.

In the same manner, the gate driver IC 32 may send gate signals to turn various pixels on and off via gate lines disposed horizontally across the display 26. In certain embodiments, multiple gate driver ICs 32 may be part of the electronic device 10 to provide gate signals to different portions of the display 26. That is, certain pixels in the display 26 may be grouped according to a portion of the display 26. Each portion of the display 26 may include a gate driver IC 32 that provides gate signals to each portion of the display 26. In certain embodiments, when the cross point nodes are positioned across the display 26 in a pseudo random order, the different gate driver ICs 32 may coordinate with each other to depict the image data provided via the processor 16 on the display 26.

Figure 2:
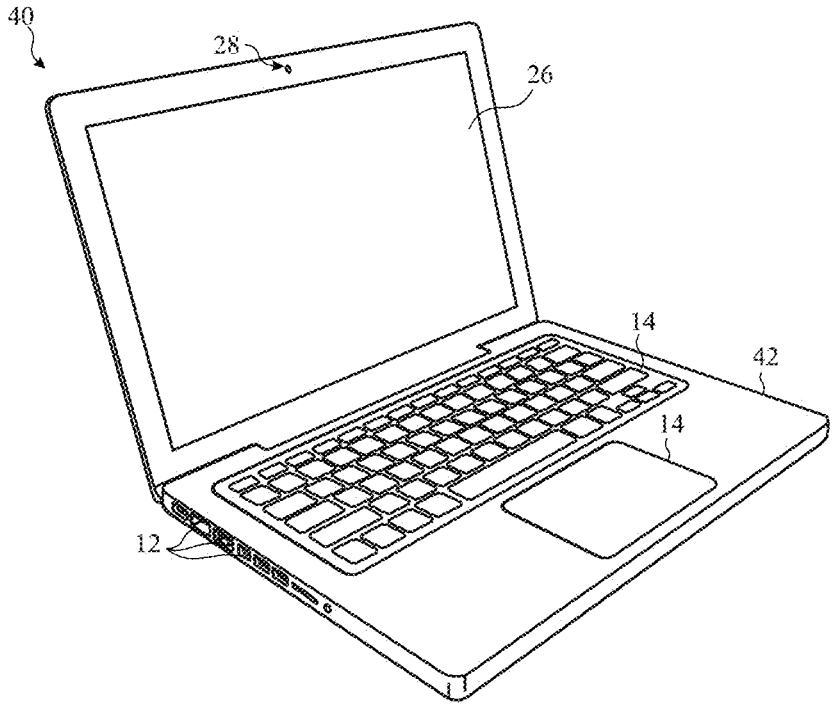
FIG. 2 is a perspective view of the electronic device of FIG. 1 in the form of a notebook computing device, in accordance with embodiments described herein.

As mentioned above, the electronic device 10 may take any number of suitable forms. Some examples of these possible forms appear in FIGS. 2-5. Turning to FIG. 2, a notebook computer 40 may include a housing 42, the display 26, the I/O ports 12, and the input structures 14. The input structures 14 may include a keyboard and a touchpad mouse that are integrated with the housing 42. Additionally, the input structure 14 may include various other buttons and/or switches which may be used to interact with the computer 40, such as to power on or start the computer, to operate a GUI or an application running on the computer 40, as well as adjust various other aspects relating to operation of the computer 40 (e.g., sound volume, display brightness, etc.). The computer 40 may also include various I/O ports 12 that provide for connectivity to additional devices, as discussed above, such as a FireWire® or USB port, a high definition multimedia interface (HDMI) port, or any other type of port that is suitable for connecting to an external device. Additionally, the computer 40 may include network connectivity (e.g., network device 24), memory (e.g., memory 18), and storage capabilities (e.g., storage device 20), as described above with respect to FIG. 1.

The notebook computer 40 may include an integrated imaging device 28 (e.g., a camera). In other embodiments, the notebook computer 40 may use an external camera (e.g., an external USB camera or a "webcam") connected to one or more of the I/O ports 12 instead of or in addition to the integrated imaging device 28. In certain embodiments, the depicted notebook computer 40 may be a model of a MacBook®, MacBook® Pro, MacBook Air®, or PowerBook® available from Apple Inc. In other embodiments, the computer 40 may be portable tablet computing device, such as a model of an iPad® from Apple Inc.

Figure 3:
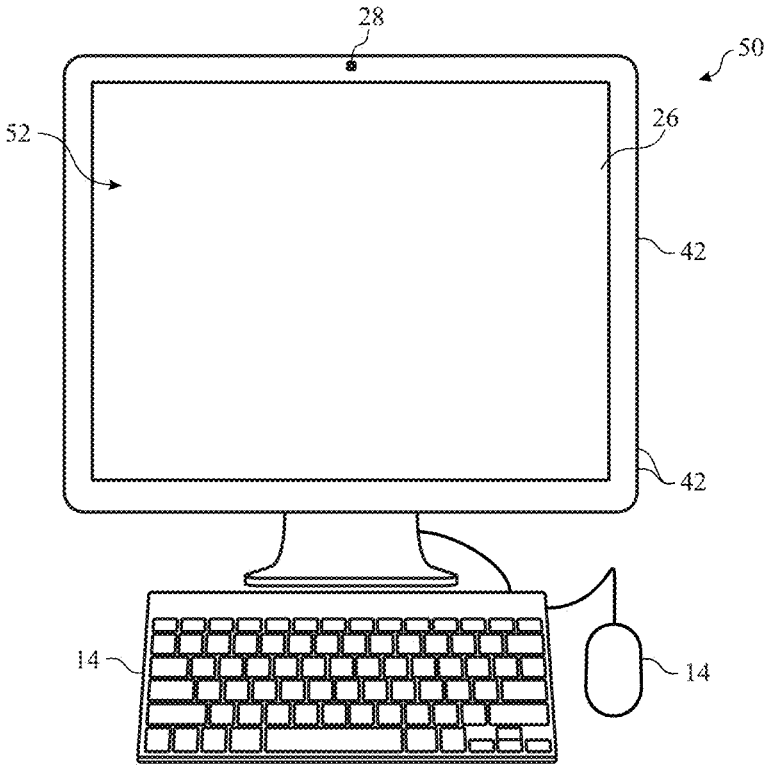
FIG. 3 is a front view of the electronic device of FIG. 1 in the form of a desktop computing device, in accordance with embodiments described herein.

FIG. 3 shows the electronic device 10 in the form of a desktop computer 50. The desktop computer 50 may include a number of features that may be generally similar to those provided by the notebook computer 40 shown in FIG. 4, but may have a generally larger overall form factor. As shown, the desktop computer 50 may be housed in an enclosure 42 that includes the display 26, as well as various other components discussed above with regard to the block diagram shown in FIG. 1. Further, the desktop computer 50 may include an external keyboard and mouse (input structures 14) that may be coupled to the computer 50 via one or more I/O ports 12 (e.g., USB) or may communicate with the computer 50 wirelessly (e.g., RF, Bluetooth, etc.). The desktop computer 50 also includes an imaging device 28, which may be an integrated or external camera, as discussed above. In certain embodiments, the depicted desktop computer 50 may be a model of an iMac®, Mac® mini, or Mac Pro®, available from Apple Inc.

Figure 4:
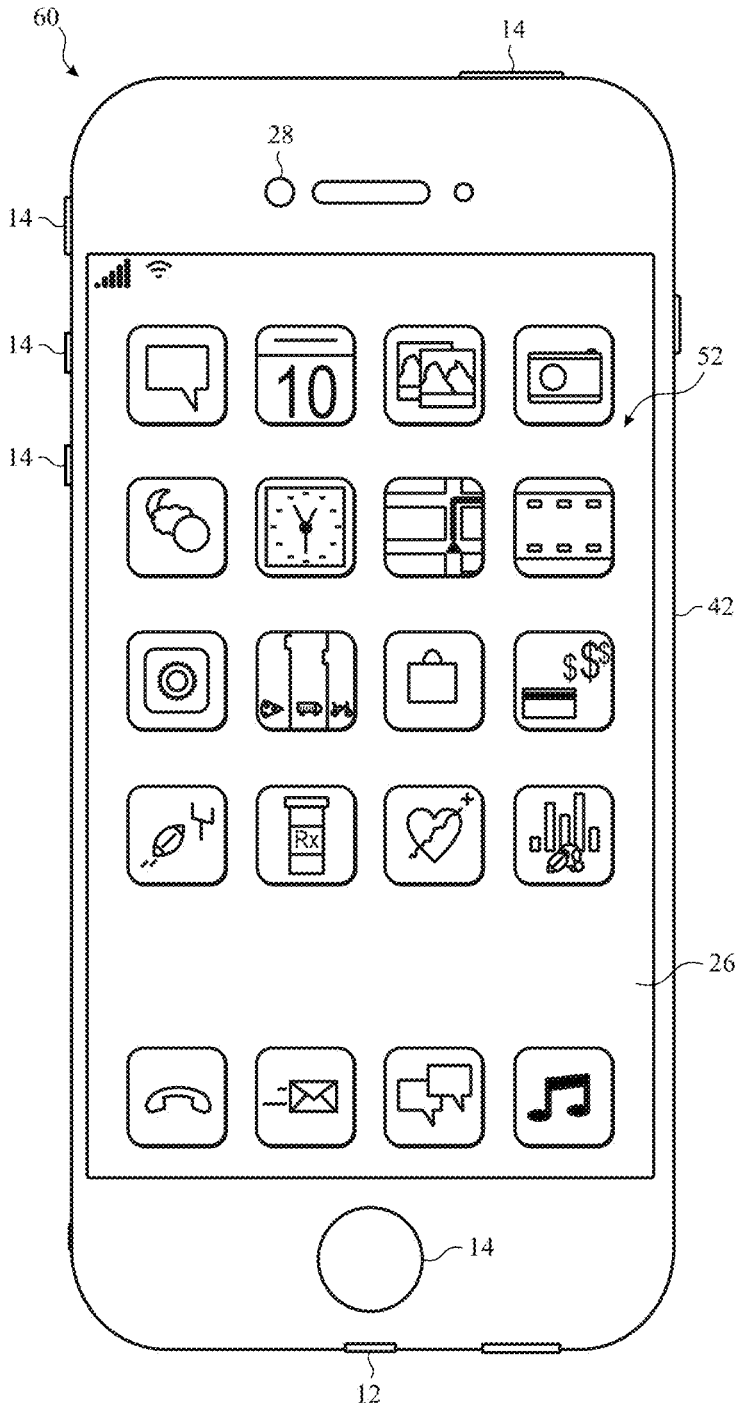
FIG. 4 is a front view of the electronic device of FIG. 1 in the form of a handheld portable electronic device, in accordance with embodiments described herein.
Figure 5:
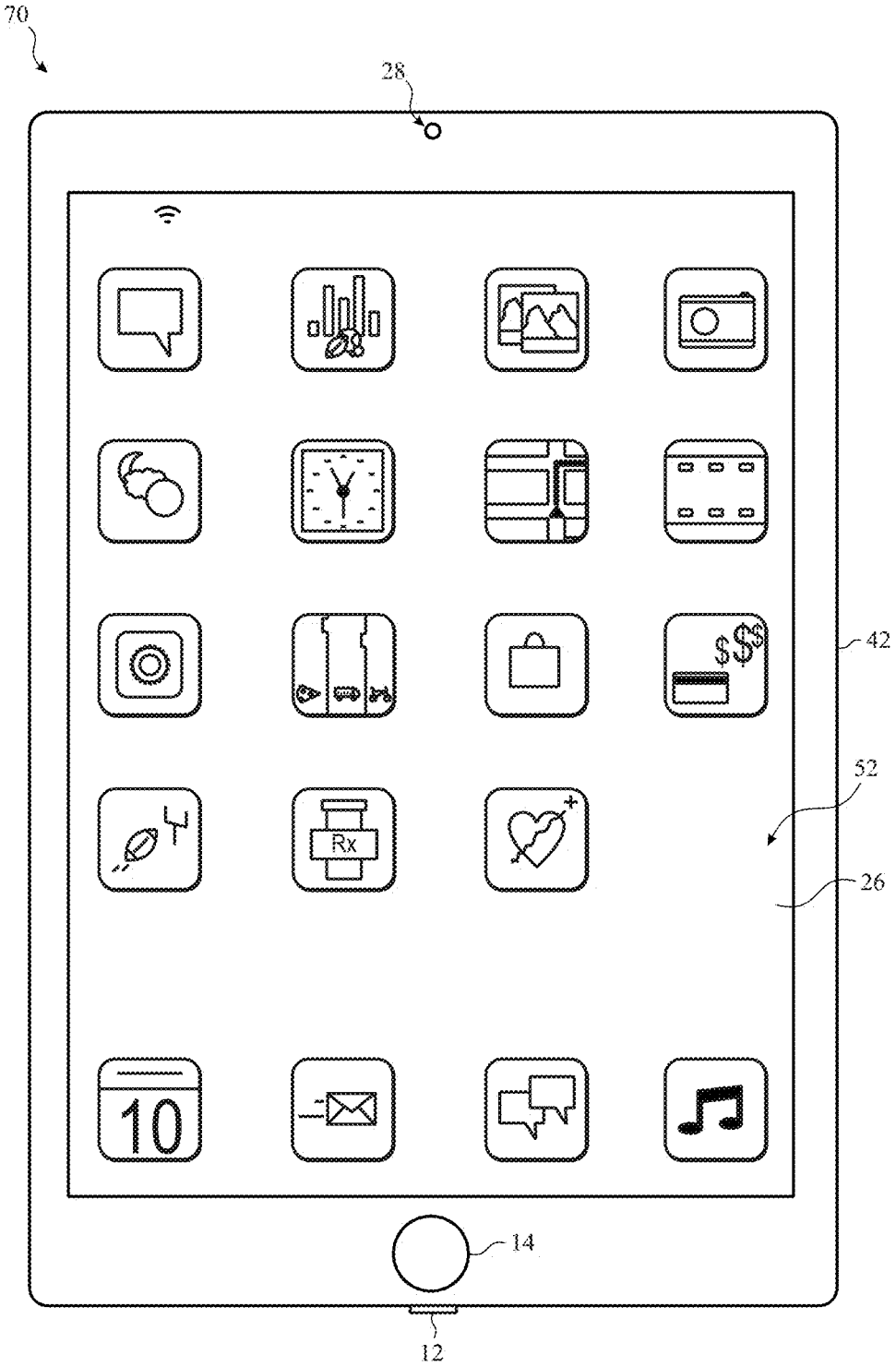
FIG. 5 is a front view of the electronic device of FIG. 1 in the form of a tablet computing device, in accordance with embodiments described herein.

The electronic device 10 may also take the form of portable handheld device 60 or 70, as shown in FIGS. 4 and 5. By way of example, the handheld device 60 or 70 may be a model of an iPod® or iPhone® available from Apple Inc. The handheld device 60 or 70 includes an enclosure 42, which may function to protect the interior components from physical damage and to shield them from electromagnetic interference. The enclosure 42 also includes various user input structures 14 through which a user may interface with the handheld device 60 or 70. Each input structure 14 may control various device functions when pressed or actuated. As shown in FIGS. 4 and 5, the handheld device 60 or 70 may also include various I/O ports 12. For instance, the depicted I/O ports 12 may include a proprietary connection port for transmitting and receiving data files or for charging a power source 24. Further, the I/O ports 12 may also be used to output voltage, current, and power to other connected devices.

The display 26 may display images generated by the handheld device 60 or 70. For example, the display 26 may display system indicators that may indicate device power status, signal strength, external device connections, and so forth. The display 26 may also display a GUI 52 that allows a user to interact with the device 60 or 70, as discussed above with reference to FIG. 3. The GUI 52 may include graphical elements, such as the icons, which may correspond to various applications that may be opened or executed upon detecting a user selection of a respective icon.

Figure 6:
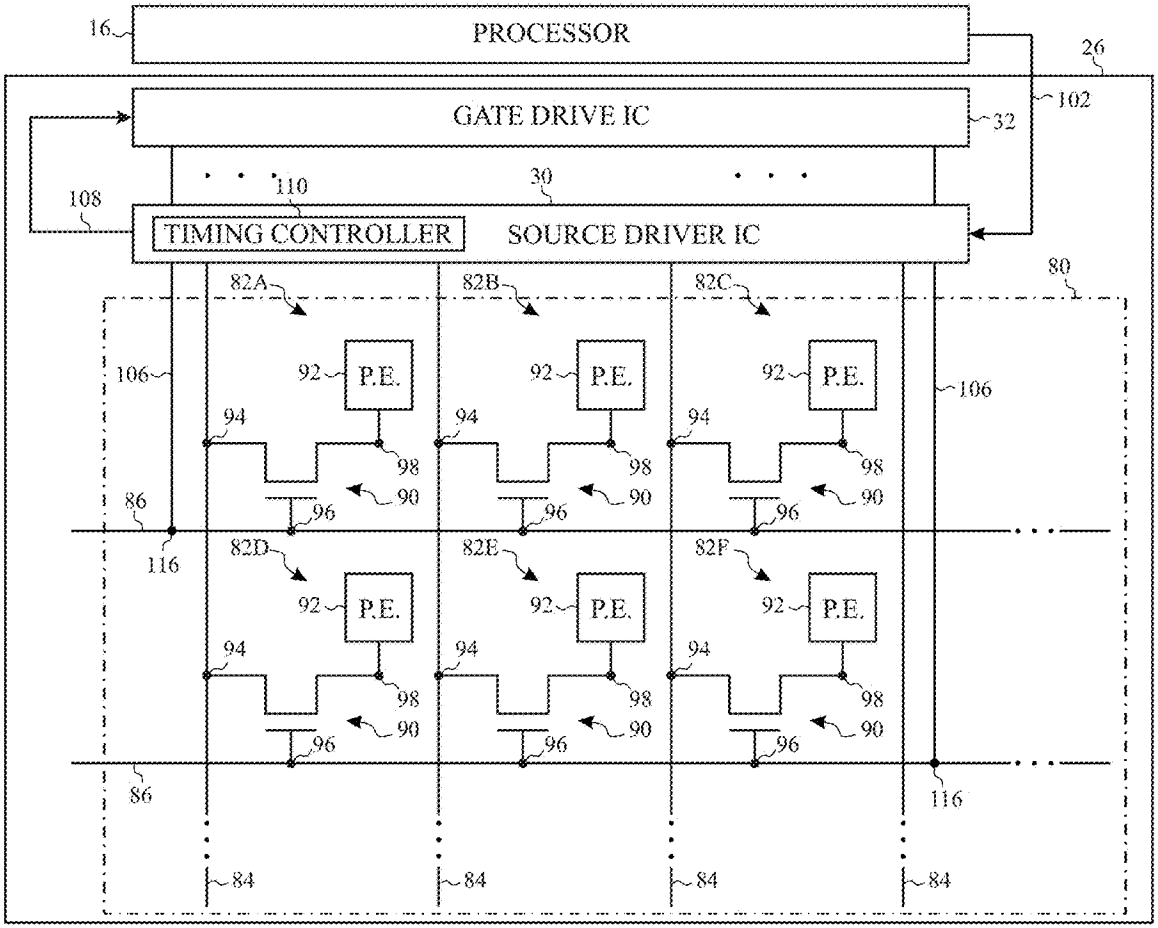
FIG. 6 is a circuit diagram illustrating an example of switching and display circuitry that may be included in the display of the electronic device of FIG. 1, in accordance with aspects of the present disclosure.

Having provided some context with regard to possible forms that the electronic device 10 may take, the present discussion will now focus on the source driver IC 30 and the gate driver IC 32 of FIG. 1. Generally, the brightness depicted by each respective pixel in the display 26 is generally controlled by varying an electric field associated with each respective pixel in the display 26. Keeping this in mind, FIG. 6 illustrates one embodiment of a circuit diagram of display 26 that may generate the electrical field that energizes each respective pixel and causes each respective pixel to emit light at an intensity corresponding to an applied voltage. As shown, display 26 may include display panel 80. Display panel 80 may include a plurality of unit pixels 82 disposed in a pixel array or matrix defining a plurality of rows and columns of unit pixels that collectively form an image viewable region of display 26. In such an array, each unit pixel 82 may be defined by the intersection of rows and columns, represented here by the illustrated gate lines 86 (also referred to as "scanning lines") and source lines 84 (also referred to as "data lines"), respectively.

Although only six unit pixels, referred to individually by the reference numbers 82*a*-82*f*, respectively, are shown in the present example for purposes of simplicity, it should be understood that in an actual implementation, each source line 84 and gate line 86 may include hundreds or even thousands of unit pixels. By way of example, in a color display panel 80 having a display resolution of 1024×768, each source line 84, which may define a column of the pixel array, may include 768 unit pixels, while each gate line 86, which may define a row of the pixel array, may include 1024 groups of unit pixels, wherein each group includes a red, blue, and green pixel, thus totaling 3072 unit pixels per gate line 86. In the context of LCDs, the color of a particular unit pixel generally depends on a particular color filter that is disposed over a liquid crystal layer of the unit pixel. In the presently illustrated example, the group of unit pixels 82*a*-82*c* may represent a group of pixels having a red pixel (82*a*), a blue pixel (82*b*), and a green pixel (82*c*). The group of unit pixels 82*d*-82*f* may be arranged in a similar manner.

As shown in the present figure, each unit pixel 82*a*-82*f* includes a thin film transistor (TFT) 90 for switching a respective pixel electrode 92. In the depicted embodiment, the source 94 of each TFT 90 may be electrically connected to a source line 84. Similarly, the gate 96 of each TFT 90 may be electrically connected to a gate line 86. Furthermore, the drain 98 of each TFT 90 may be electrically connected to a respective pixel electrode 92. Each TFT 90 serves as a switching element that may be activated and deactivated (e.g., turned on and off) for a predetermined period based upon the respective presence or absence of a scanning signal at gate 96 of TFT 90. For instance, when activated, TFT 90 may store the image signals received via a respective source line 84 as a charge in pixel electrode 92. The image signals stored by pixel electrode 92 may be used to generate an electrical field that energizes the respective pixel electrode 92 and causes the pixel 82 to emit light at an intensity corresponding to the voltage applied by the source line 84. For instance, in an LCD panel, such an electrical field may align liquid crystals molecules within a liquid crystal layer to modulate light transmission through the liquid crystal layer.

In certain embodiments, the display 26 may further include the source driver integrated circuit (source driver IC) 30, which may include a chip, such as a processor or ASIC, that may control various aspects of display 26 and panel 80. For example, source driver IC 30 may receive image data 102 from processor(s) 16 and send corresponding image signals to unit pixels 82*a*-82*f* of panel 80. Source driver IC 30 may also be coupled to gate driver IC 32, which may be configured to activate or deactivate pixels 82 via gate lines 86 and voltage gate lines (v-gate lines) 106. As such, source driver IC 30 may send timing information, shown here by reference number 108, via a timing controller 110 to gate driver IC 32 to facilitate activation/deactivation of individual rows of pixels 82. While the illustrated embodiment shows a single source driver IC 30 coupled to panel 80 for purposes of simplicity, it should be appreciated that additional embodiments may utilize a plurality of source driver ICs 30. For example, additional embodiments may include a plurality of source driver ICs 30 disposed along one or more edges of panel 80, wherein each source driver IC 30 is configured to control a subset of source lines 84 and/or gate lines 86.

The v-gate lines 106 may be disposed parallel to the source lines 84. In certain embodiments, the v-gate lines 106 may be disposed underneath or above the source lines 84 on a different layer of the panel 80. In any case, the v-gate lines 106 may provide gate voltage signals to the gate lines 86 to control the operation of the TFT 90. By employing v-gate lines 106 and gate lines 86, the gate driver IC 32 may be positioned along the same edge of the panel 80 as the source driver IC 30. As a result, the other edges of the panel 80 may include less circuitry and thus may be designed to form a variety of different shapes and reduce the size of the respective bezel regions.

In operation, source driver IC 30 receives image data 102 from processor 16 and, based on the received data, outputs signals to control pixels 82. To display image data 102, source driver IC 30 may adjust the voltage of pixel electrodes 92 (abbreviated in FIG. 4 as P.E.) one row at a time. To access an individual row of pixels 82, gate driver IC 32 may send an activation signal to TFTs 90 associated with the particular row of pixels 82 being addressed. This activation signal may render the TFTs 90 on the addressed row conductive. Accordingly, image data 102 corresponding to the addressed row may be transmitted from source driver IC 30 to each of the unit pixels 82 within the addressed row via respective data lines 84. Thereafter, gate driver IC 32 may deactivate TFTs 90 in the addressed row, thereby impeding the pixels 82 within that row from changing state until the next time they are addressed. The above-described process may be repeated for each row of pixels 82 in panel 80 to reproduce image data 102 as a viewable image on display 26.

In sending image data to each of the pixels 82, a digital image is typically converted into numerical data so that it can be interpreted by a display device. For instance, the image 102 may itself be divided into small "pixel" portions, each of which may correspond to a respective pixel 82 of panel 80. To avoid confusion with the physical unit pixels 82 of the panel 80, the pixel portions of the image 102 shall be referred to herein as "image pixels." Each "image pixel" of image 102 may be associated with a numerical value, which may be referred to as a "data number" or a "digital luminance level," that quantifies the luminance intensity (e.g., brightness or darkness) of the image 102 at a particular spot. The digital level value of each image pixel typically represents a shade of darkness or brightness between black and white, commonly referred to as gray levels. As will be appreciated, the number of gray levels in an image usually depends on the number of bits used to represent pixel intensity levels in a display device, which may be expressed as $2^N$ gray levels, where N is the number of bits used to express a digital level value. By way of example, in an embodiment where display 26 is a "normally black" display using 8 bits to represent a digital level, display 26 may be capable of providing 256 gray levels to display an image, wherein a digital level of 0 corresponds to full black (e.g., no transmittance), and a digital level of 255 correspond to full white (e.g., full transmittance). In another embodiment, if 6 bits are used to represent a digital level, then 64 gray levels may be available for displaying an image.

To provide some examples, in one embodiment, source driver IC 30 may receive an image data stream equivalent to 24 bits of data, with 8-bits of the image data stream corresponding to a digital level for each of the red, green, and blue color channels corresponding to a pixel group including red, green, and blue unit pixel (e.g., 82*a*-82*c* or 82*d*-82*f*). In another embodiment, source driver IC 30 may receive 18-bits of data in an image data stream, with 6-bits of the image data corresponding to each of the red, green, and blue color channels, for example. Further, although digital levels corresponding to luminance are generally expressed in terms of gray levels, where a display utilizes multiple color channels (e.g., red, green, blue), the portion of the image corresponding to each color channel may be individually expressed as in terms of such gray levels. Accordingly, while the digital level data for each color channel may be interpreted as a grayscale image, when processed and displayed using unit pixels 82 of panel 80, color filters (e.g., red, blue, and green) associated with each unit pixel 82 allows the image to be perceived as a color image.

Figure 7:
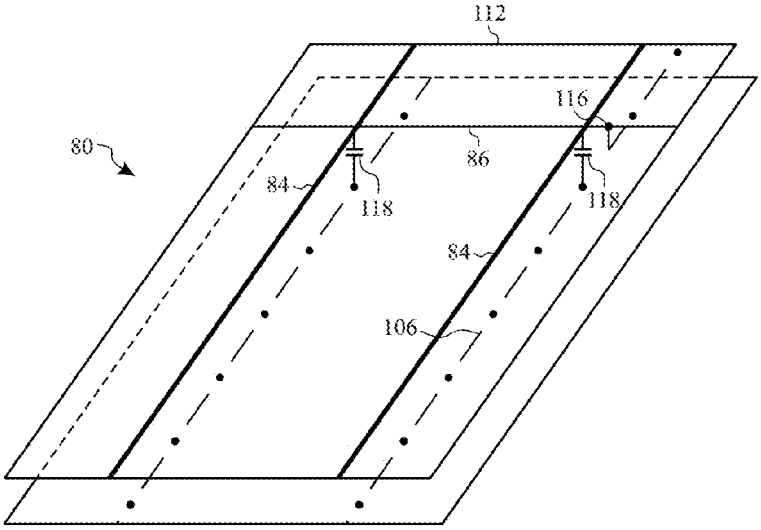
FIG. 7 is a circuit diagram illustrating example layouts of voltage-gate lines (v-gate lines), gate lines, and source lines that may be part of the display in the electronic device of FIG. 1, in accordance with aspects of the present disclosure.

With the foregoing in mind, FIG. 7 illustrates an exploded perspective view of the panel 80. As shown in FIG. 7, the panel 80 may include a layer 112 and a layer 114. The layer 112 may include the source lines 84 and the gate lines 86. The layer 114 may include the v-gate lines 106, and the v-gate lines 106 may electrically couple to the gate line 86 via a cross point node 116. The v-gate line 106 may couple to the gate line 86 at the cross point node 116 using metal vias or the like. Generally, each v-gate line 106 may couple to a respective gate line 86 via a respective cross point node 116. As such, signals generated by the gate driver IC 32 may be provided to the gate line 86 via the cross point node 116 and the v-gate lines 106. In operation, when providing voltage signals to the gate line 86, the voltage applied to the TFT 90 of a respective may be a high or low voltage used to activate or deactivate the pixel electrode 92 of the respective pixel 82.

Figure 8:
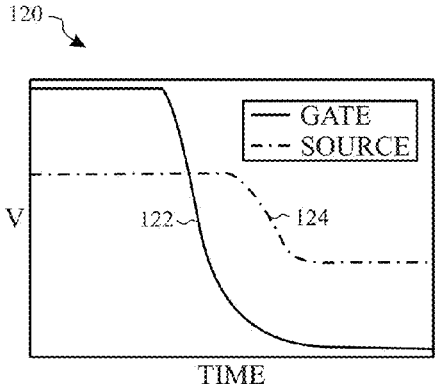
FIG. 8 is a graph of expected voltage and data line signals received by a pixel of the display in the electronic device of FIG. 1 via a respective gate line and a respective source line, in accordance with aspects of the present disclosure.

In some cases, when transitioning from a high voltage to a low voltage, the expected signal received by the respective pixel electrode 92 via the gate line 86 may correspond to the voltage signal 122 depicted in the graph 120 of FIG. 8. In the same manner, the expected signal received by the respective pixel electrode 92 via the respective source line 84 may correspond to the data line signal 124.

However, due to the proximity between each respective source line 84 and each respective v-gate line 106, the cross point node 116 may experience a voltage kickback disturbance. This kickback disturbance is caused due to a coupling effect that occurs between the v-gate line 106 and source line 84. That is, since the v-gate line 106 may be disposed underneath the source line 84, a coupling effect may be induced due to the respective voltages present on each line. Generally, the kickback disturbance may be more pronounced at a pixel located near a cross point node 116, as compared to pixels located further away from the cross point node 116.

Figure 9:
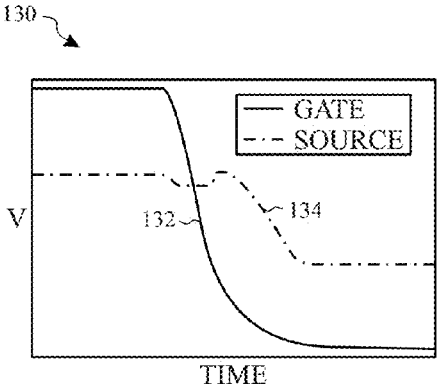
FIG. 9 is a graph of example voltage and data line signals received by a pixel of the display in the electronic device of FIG. 1 via a respective gate line and a respective source line, in accordance with aspects of the present disclosure.

For instance, FIG. 9 depicts a graph 130 that illustrates an example data line signal that may experience a kickback disturbance induced by the coupling effect between the source line 86 and the v-gate line 106. As shown in FIG. 9, a voltage signal 132 may represent a voltage of a respective gate line 86, and a data line signal 134 may represent a voltage received by the respective pixel electrode 92 via a respective source line 84. When the voltage signal 132 transitions from high to low, the respective pixel electrode 92 may receive a kickback disturbance or voltage disturbance that may distort the data line signal 134 being transmitted via the respective source line 86. That is, the kickback voltage may be induced from a gate coupling to the source line 84 above the v-gate line 106. The kickback voltage may then be transferred through the respective TFT 90 to the respective pixel electrode 92 during gate turn off or turn on. In the example depicted in FIG. 9, the data line signal 134 may decrease when the voltage signal 132 transitions from high to low. As a result, the respective pixel electrode 92 may not produce a desired brightness or grey level, as specified by the image data 102.

Referring back to FIG. 7, the kickback disturbance or voltage may be generated due at least partly to a coupling effect between the source line 84 and the v-gate line 106. The coupling effect is represented in the panel 80 of FIG. 7 as a capacitance 118 between the source line 84 and the v-gate line 106. As mentioned above, the pixels 82 located at or near the cross point nodes 116 may experience a larger amount of kickback voltage as compared to other pixels along the respective gate line 86. In some cases, the kickback voltage may be up to 300 mV, which may distort the images depicted on the display 26.

Figure 10:
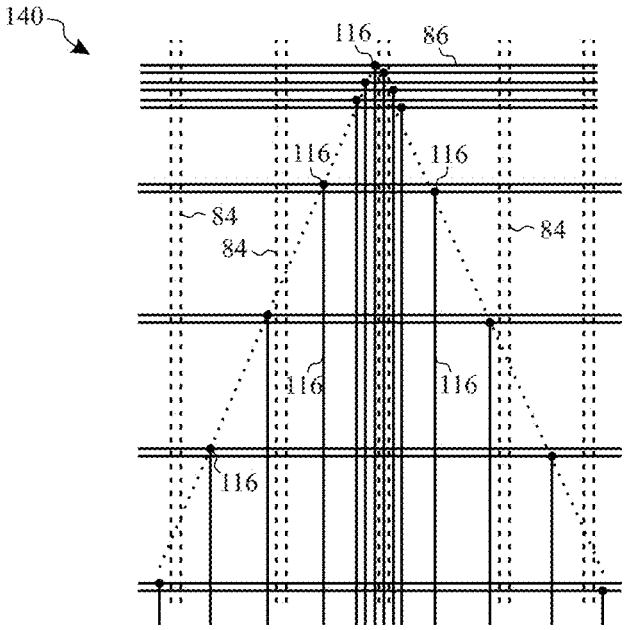
FIG. 10 is a circuit diagram illustrating example locations of cross point pixels of the display in the electronic device of FIG. 1, in accordance with aspects of the present disclosure.

Keeping this in mind, FIG. 10 is an example layout 140 that illustrates sample positions of cross point nodes 116 with respect to source lines 84, gate lines 86, and v-gate lines 106. Although FIG. 10 illustrates a particular layout of the cross point nodes 116, it should be understood that, in other embodiments, the cross point nodes 116 may be positioned in other arrangements.

Figure 11:
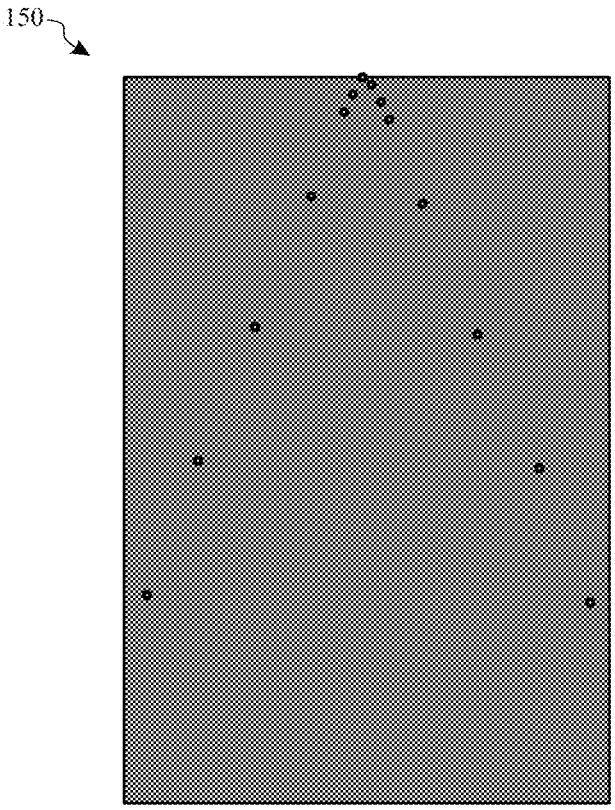
FIG. 11 is an illustration of visual effects that may be depicted in the display in the electronic device of FIG. 1, in accordance with aspects of the present disclosure.

FIG. 11 illustrates an example image 150 depicted on the display 26 having the cross point nodes 116 positioned according to the layout of FIG. 10. The example image 150 may depict image data that displays the same grey level value for each pixel in the example image 150. However, as shown in the example image 150 of FIG. 10, the pixels located at or near the cross point nodes 116 each have a lower grey level, as compared to the remaining pixels in the example image 150. This reduced grey level may be induced by the coupling effect between the gate lines 86 and the v-gate lines 106 discussed above.

With the foregoing in mind, in certain embodiments, the cross point nodes 116 may be arranged in a pseudo random manner across the panel 80 to detract a viewer of the image data depicted on the display 26 from the kickback voltage effects described above. In one embodiment, each cross point node 116 may be positioned on the panel 80 such that straight-line edges are avoided and clusters of cross point nodes 116 (e.g., cross point nodes 116 located near one another) are minimized. In some embodiments, it may be useful to position the cross point nodes 116 behind blue sub-pixels of a pixel to reduce the visual effects of the kickback voltage.

In some cases, the positions of the cross point nodes 116 may be selected in a random manner. However, in these instances, some of the cross point nodes 116 may still be randomly positioned to form straight-line edges. As such, a pseudo random arrangement of cross point nodes that accounts for avoiding straight-line edges and clusters of cross point nodes 116 is desirable With this mind, FIG. 12 illustrates a sample chart 170 that indicates potential locations for cross point nodes 116 within a panel 80. As shown in chart 170, the x and y coordinates of the cross point nodes 116 may be determined based on a reverse binary bit sequence or a bit sequence that increases from its most significant bit, as opposed to its least significant bit. For example, referring to the chart 170, the first cross point node (e.g., y-coordinate of 0) may correspond to a bit sequence of all zeros, which is equal to decimal value of 0. The 0 decimal value may correspond to the x-coordinate of the cross point node 116. In the same manner, the second cross point node (e.g., y-coordinate of 1) may correspond to a bit sequence where the most significant bit is incremented by one and the remaining bits are zero. The decimal value of the bit sequence associated with second cross point node 116 may thus be equal to 1024, which may correspond to the x-coordinate of the second cross point node 116.

Figure 13:
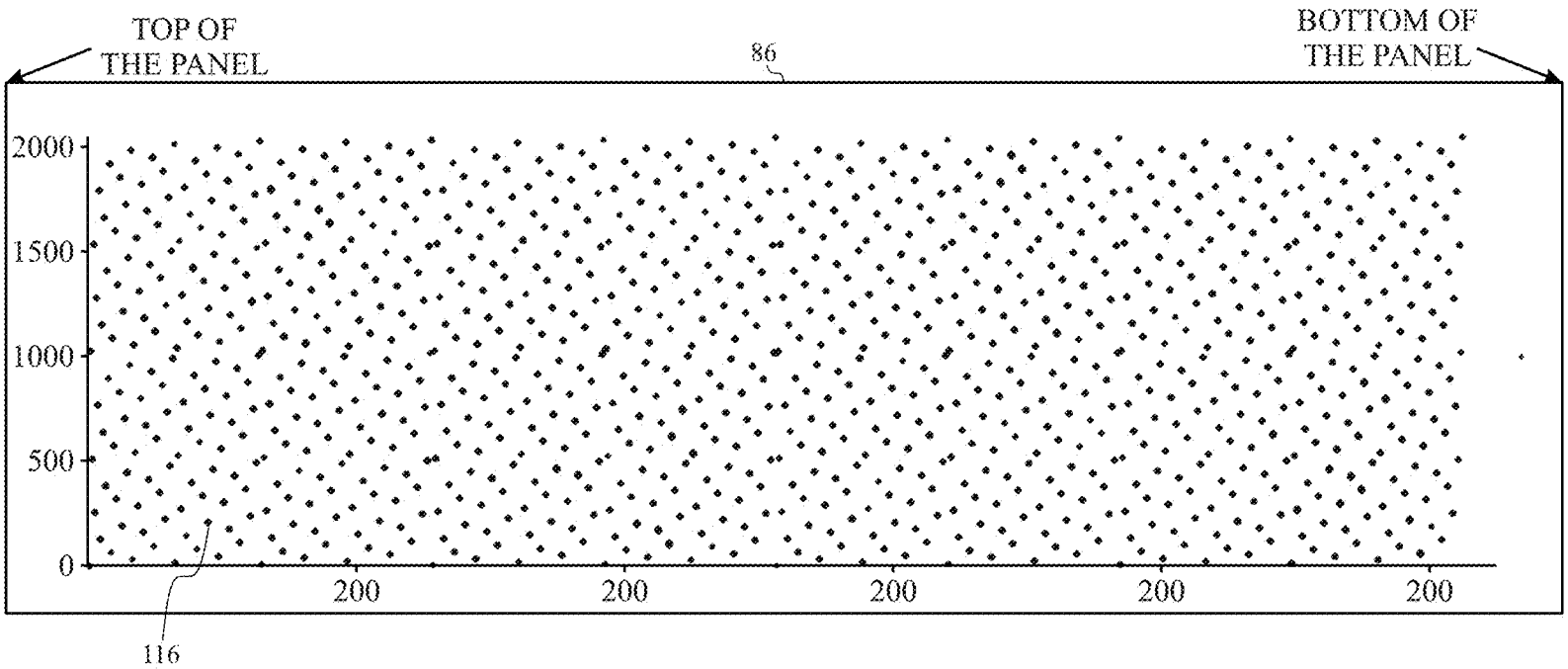
FIG. 13 illustrates locations of the cross point nodes as specified according to the sample chart of FIG. 12, in accordance with aspects of the present disclosure.

Continuing this pattern, the resulting locations of the cross point nodes 116 are depicted in FIG. 13. By determining the locations of the cross point nodes 116 based on the reverse binary bit sequence, the layout of the cross point nodes 116 may form a pseudo random pattern, such that each adjacent cross point node 116 generally alternates with respect to a vertical line about the center of the panel 80. In any case, two adjacent cross point nodes 116 are not located within a certain radius of each other, and thus are not likely to be part of a cluster. Moreover, three or more adjacent cross point nodes 116 may not form a straight line edge, since each adjacent cross point node 116 alternates across the panel 80. In one embodiment, the approximate number of cross point nodes 116 may be determined based on a minimum amount of cross point connections that forms a cluster in such a way that front of screen (FOS) becomes visible.

minimum amount of cross point connections that forms a cluster in such a way that front of screen (FOS) becomes visible Although the first column of the chart 170 is described as the y-coordinate and the last column is the x-coordinate of the cross point nodes 116, it should be noted that the y and x coordinates of the cross point nodes 116 may also be reversed with respect to the first column and the last column. In this way, positions of adjacent cross point nodes 116 may alternate over a horizontal line across the panel 80.

Figure 14:
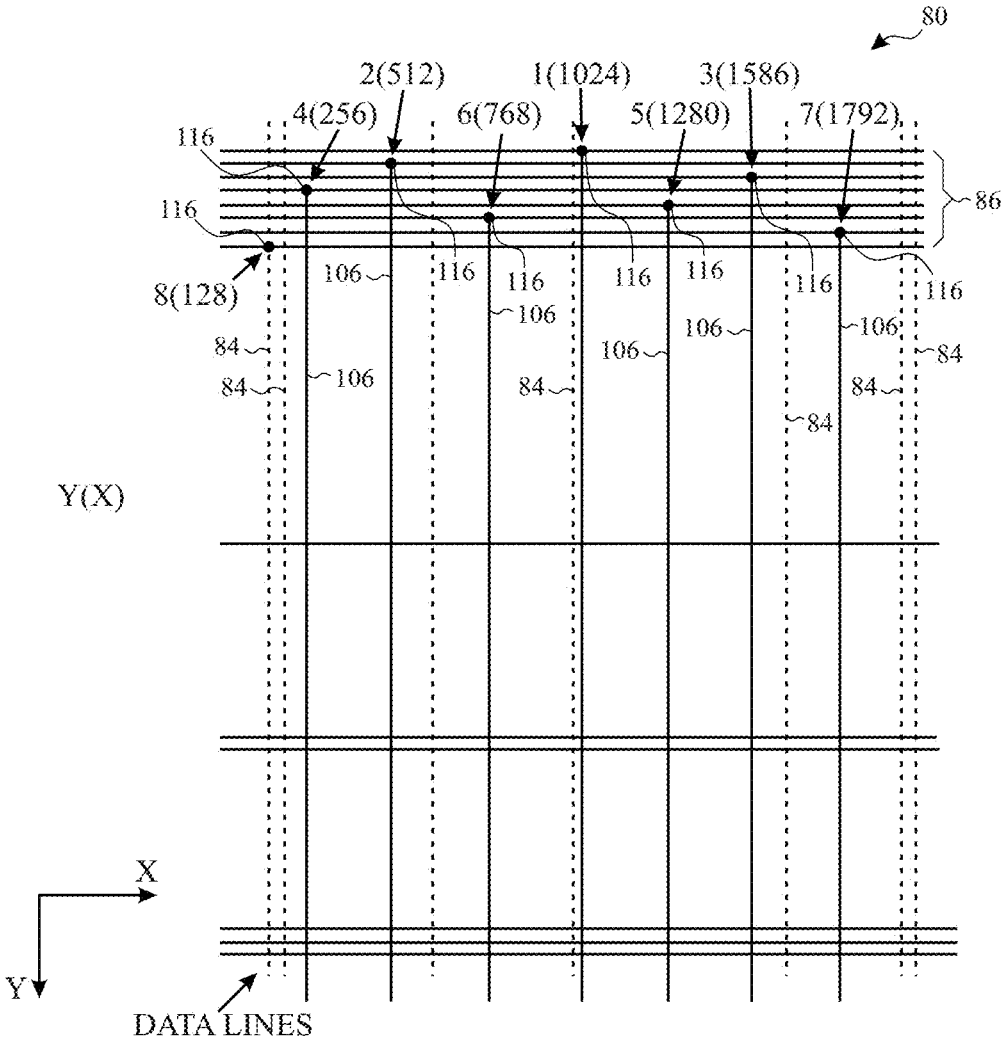
FIG. 14 illustrates locations of the cross point nodes that alternate according to different sides of the display in the electronic device of FIG. 1, in accordance with aspects of the present disclosure.

To provide an example of locations of cross point nodes 116, FIG. 14 illustrates cross point nodes 116 according to the coordinates provided in the chart 170 of FIG. 12. As shown in FIG. 14, the first cross point node 116 is positioned having a y-coordinate of 1 and an x-coordinate of 1024; the second cross point node 116 is positioned having a y-coordinate of 2 and an x-coordinate of 512, the third cross point node 116 is positioned having a y-coordinate of 3 and an x-coordinate of 1536, and so forth, as per the values indicated in the chart 170. As shown in the figure, adjacent cross point nodes 116 alternate between the left and right side of the panel 80. For example, the second cross point node 116 (2, 512) is located on an alternate side of the panel 80 with respect to the third cross point node 116 (3, 1536).

When the cross point nodes 116 are arranged in a pseudo random pattern as described above, the complexity of driving each gate line 86 via the gate driver IC 32 is increased. That is, in conventional displays 26, the gate driver IC 32 may drive a row of pixels in successive order from top to bottom. However, since the cross point nodes 116 are not positioned in an ordered manner from top to bottom of the display 26, the gate driver IC 32 may send gate drive signals to each cross point node 116 using an algorithmic approach that tracks the location of each cross point node 116 and sends a gate drive signal to each cross point node 116 in a successive order (e.g., from top to bottom). In this case, given the wide variety of locations for the cross point nodes 116, the gate driver IC 32 may include a memory component that stores the chart 170 or the information regarding the location of each cross point node 116. In one embodiment, the memory component may include a look up table that provides information used to drive each cross point node 116 is some order.

Although the display 26 is described as having one source driver IC 30 and one gate driver IC 32, it should be noted that, in certain embodiments, the display 26 may include multiple source driver ICs 30 and multiple gate driver ICs 32. In some instances, one of the multiple source driver ICs 30 and one of the multiple gate driver ICs 32 may be embedded into a single gate embedded column driver IC. In this case, multiple gate embedded column driver ICs may provide gate and data signals to pixels disposed in different portions of the display 26.

Figure 15:
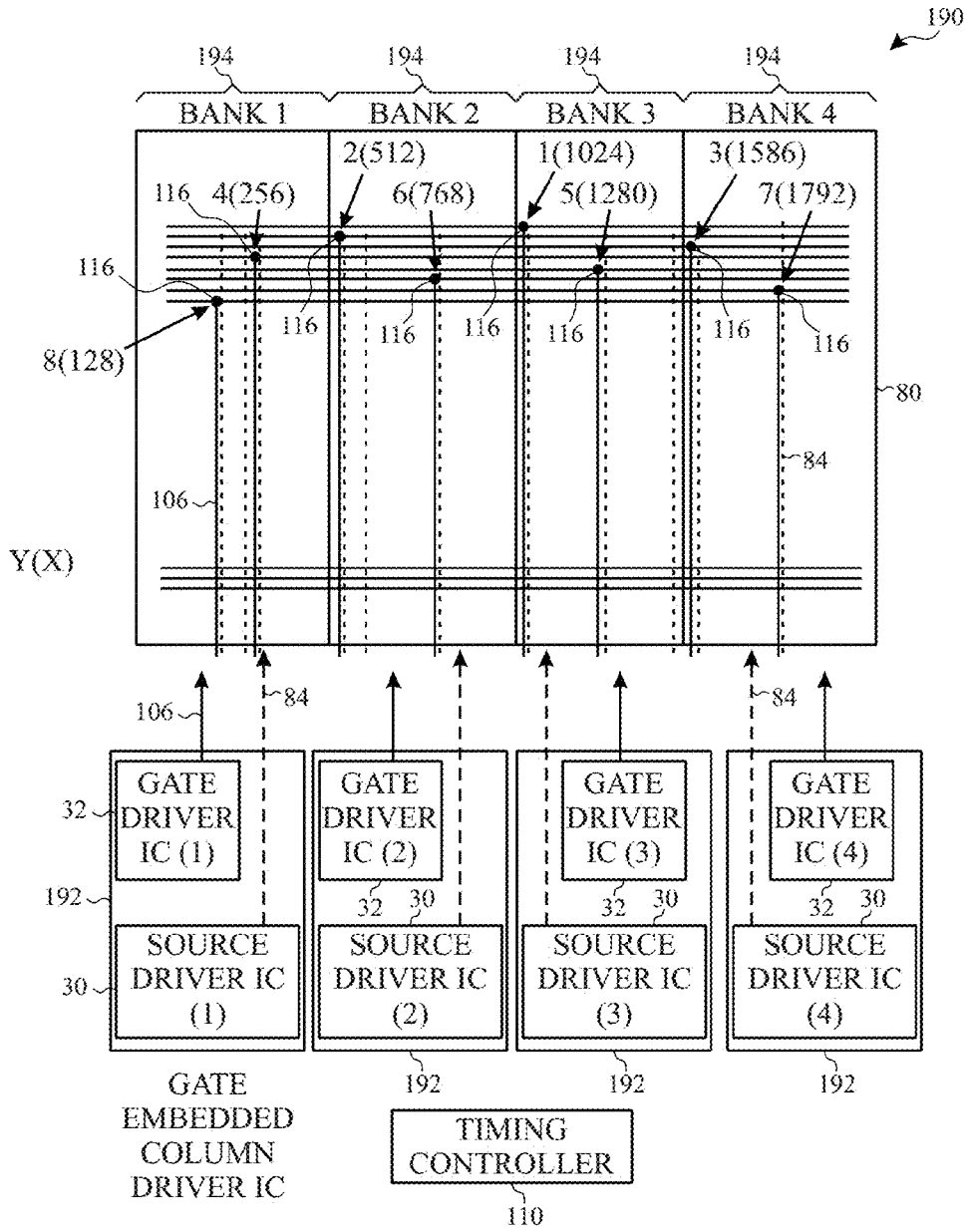
FIG. 15 illustrates four gate embedded source driver integrated circuits (ICs) that control the voltages provided to various gate lines of the display in the electronic device of FIG. 1, in accordance with aspects of the present disclosure.

With this in mind, FIG. 15 illustrates a schematic diagram 190 of four gate embedded column driver integrated circuits (ICs) 192 that collectively provide gate and data signals to pixels of the panel 80. Although four gate embedded column driver ICs 192 are depicted throughout this disclosure, it should be noted that any suitable number of gate embedded column driver ICs 192 may be used to drive the pixels of the panel 80. As shown in FIG. 15, each gate embedded column driver IC 192 may include a source driver IC 30 and a gate driver IC 32. The panel 80 may be divided into four equal banks 194 that correspond to the four gate embedded column driver ICs 192. As such, each gate embedded column driver IC 192 may send gate and data signals to pixels located in a respective bank 194 of the panel 80 via v-gate lines 106 and source lines 84, respectively. That is, each gate driver IC 32 and each source driver IC 30 of each gate embedded column driver IC 192 may send the send gate and data signals to pixels located in a respective bank 194 of the panel 80.

In certain embodiments, the timing in which each signal is sent from each gate embedded column driver IC 192 may be controlled and coordinated by the timing controller 110. That is, the timing controller 110 may send commands to each gate embedded column driver IC 192 indicating when the gate signals and the data signals for each respective pixel should be transmitted. The timing controller 110 may access the memory component that includes information regarding the arrangement or layout of the cross point nodes 116. Using this information, the timing controller 110 may coordinate when each gate embedded column driver IC 192 may send its gate signals and data signals. In one embodiment, the timing controller 110 may send gate signals to each gate line 86 via a respective v-gate line 106 in order from the top of the panel 80 to the bottom of the panel 80. In the same manner, the timing controller 110 may send data signals to each data line 84 in order from the left of the panel 80 to the right of the panel 80.

To drive each bank 194 of the display 26, the timing controller 110 may interleave the driving of each bank 194 using the four gate embedded column driver ICs 192. The timing controller 110 may thus use certain decoding logic to determine a driving sequence of each bank 194. Using the known addresses or coordinates of each cross point node 116, the decoding logic may determine a sequence in which each gate driver IC 32 and each source driver IC 30 of each gate embedded column driver IC 192 may send each respective gate signal and data signals to various pixels of the display 26. It should be noted that since the cross point nodes 116 are positioned according to a pseudo random order, the driving pattern for each gate embedded column driver IC 192 may not be the same.

Although using multiple gate embedded column driver ICs 192 to drive different banks of the display 26 may reduce demand on each piece of hardware driving the display 26, it may be useful to coordinate the driving of each bank 194 according to some pattern. With this in mind, FIG. 16 illustrates a schematic diagram 200 of four gate embedded column driver integrated circuits (ICs) 192 that collectively provide gate and data signals to pixels of the panel 80 according to a repetitive horizontal pattern.

Figure 16:
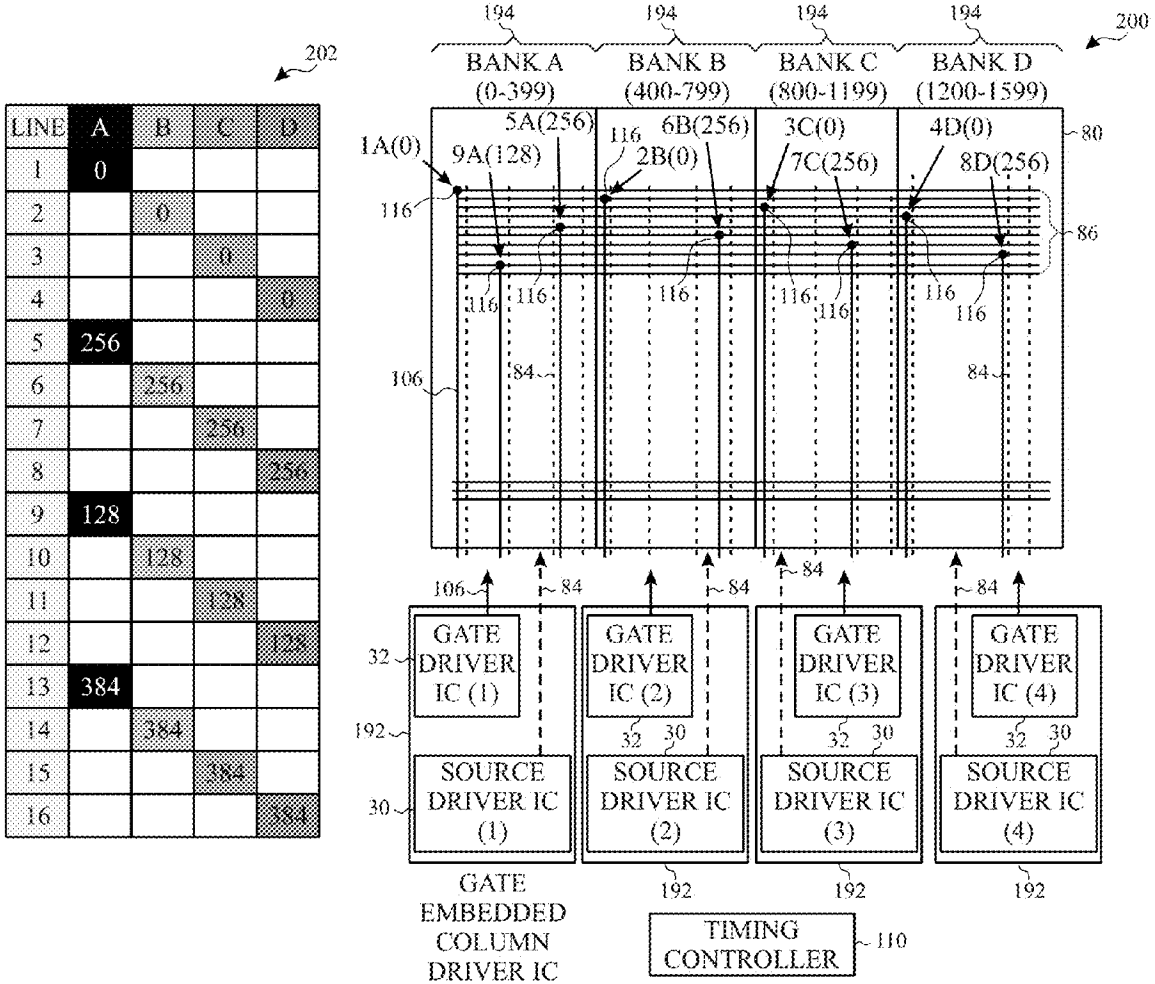
FIG. 16 illustrates four gate drive integrated circuits (ICs) that control the voltages provided to various gate lines of the display in the electronic device of FIG. 1 according to an horizontally repeated pattern, in accordance with aspects of the present disclosure.

As shown in FIG. 16, the panel 80 is divided into four equal banks 194. In one embodiment, a position for each cross point node 116 in each bank 194 may be determined based on each respective bank 194 of pixels. That is, the cross point nodes 116 of each bank 194 of pixels may be positioned independently. For example, if the entire panel 80 depicted in FIG. 16 includes 2048 gate lines 86, each bank 194 may include 512 gate lines 86. To represent each gate line 86 of each bank 194, each gate line 86 may be addressed using a bit sequence value that includes nine bits. Incrementing the most significant bit of a 9-bit value from zero provides values of: 0 (000000000), 256 (100000000), 128 (010000000), 384 (110000000), etc.

After determining an address for 512 cross point nodes 116 in each bank 194, to ensure that each gate line 86 of the panel 80 includes just one cross point node 116, the pattern of addresses used for a portion of the cross point nodes 116 may be repeated for each bank 194 depending on the number of total banks 194 present on the panel 80. For instance, referring to an address chart 202 depicted in FIG. 16, the address for each cross point node 116 may be repeated at each bank 194 for each successive gate line 86. That is, the cross point node 116 for gate line 1 of bank A, for gate line 2 of bank B, for gate line 3 of bank C, and for gate line 4 of bank C are all located at x-coordinate 0. In the same manner, the cross point node 116 for gate line 5 of bank A, for gate line 6 of bank B, for gate line 7 of bank C, and for gate line 8 of bank C are all located at x-coordinate 256. As such, the pattern of addresses for each cross point node 116 of each bank 194 is the same with a shift down with respect to each gate line 86. The timing controller 110 may be aware of this pattern via the information stored on the memory component and thus may drive each gate embedded column driver IC 192 according to the same pattern at different times. By using the repeatable pattern depicted in FIG. 16, similarly designed gate embedded column driver ICs 192 may be used to drive the pixels of each bank 194. These similarly gate embedded column driver ICs 192 may be interchangeable with each other. Moreover, during operation, the gate embedded column driver ICs 192 may operate interleaved with each other. Using the horizontal pattern described herein, the driving pattern for pixels per bank 194 may be identical for each gate embedded column driver IC 192.

Figure 17:
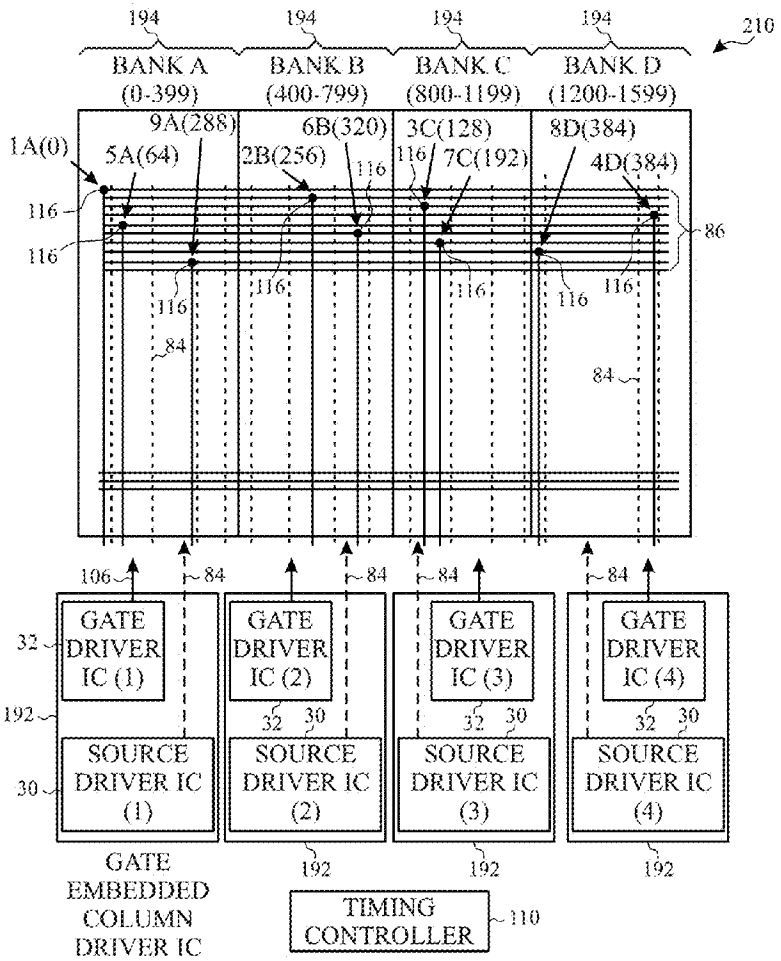
FIG. 17 illustrates four gate drive integrated circuits (ICs) that control the voltages provided to various gate lines of the display in the electronic device of FIG. 1 according to an vertically repeated pattern, in accordance with aspects of the present disclosure.

In another embodiment, the cross point nodes 116 may be positioned according to a vertical pattern as illustrated in FIG. 17. FIG. 17 illustrates a schematic diagram 220 of four gate embedded column driver integrated circuits (ICs) 192 that collectively provide gate and data signals to pixels of the panel 80 according to a repetitive vertical pattern.

Like the schematic diagram 210 of FIG. 16, the panel 80 of the schematic diagram 220 is divided into four equal banks 194. Also like the schematic diagram 210 of FIG. 16, the cross point nodes 116 of each bank 194 of pixels of the schematic diagram 220 may be positioned independently.

However, instead of repeating a horizontal addressing pattern as provided in the address chart 202, the pattern of addresses used for a portion of the cross point nodes 116 may be vertically repeated for each bank 194 depending on the number of total banks 194 present on the panel 80. For instance, referring to an address chart 212 depicted in FIG. 17, the address for each cross point node 116 may be selected successively for each gate line 86 at each bank 194. That is, the cross point node 116 for gate line 1 of bank A is located at x-coordinate 0, for gate line 2 of bank B is located at x-coordinate 256, for gate line 3 of bank C is located at x-coordinate 128, and for gate line 4 of bank C is located at x-coordinate 384. Continuing the vertical addressing pattern described above, the cross point node 116 for gate line 5 of bank A is located at x-coordinate 64 (001000000), for gate line 6 of bank B is located at x-coordinate 320 (101000000), for gate line 7 of bank C is located at x-coordinate 192 (110000000), and for gate line 8 of bank C is located at x-coordinate 448 (111000000). As such, each cross point node 116 is assigned a position according to a round robin manner of assignment based on a number of banks 194 present in the panel 80.

After the first 512 cross point nodes 116 of the four banks 194 have been addressed according to the pattern described above, the addressing pattern is repeated starting at gate line 3 of bank B. This pattern is continuously repeated until each gate line 86 has a corresponding cross point node 116. The timing controller 110 may be aware of this pattern via the information stored on the memory component and thus may drive each gate embedded column driver IC 192 according to the same pattern at different times. By using the repeatable pattern depicted in FIG. 17, similarly designed gate embedded column driver ICs 192 may be used to drive the pixels of each bank 194. These similarly gate embedded column driver ICs 192 may be interchangeable with each other. Moreover, during operation, the gate embedded column driver ICs 192 may operate interleaved with each other. It should be noted that using the vertical pattern of addressing, each gate embedded column driver IC 192 may not use a similar driving pattern as each other due to the manner in which each cross point node 116 is positioned.

Figure 18:
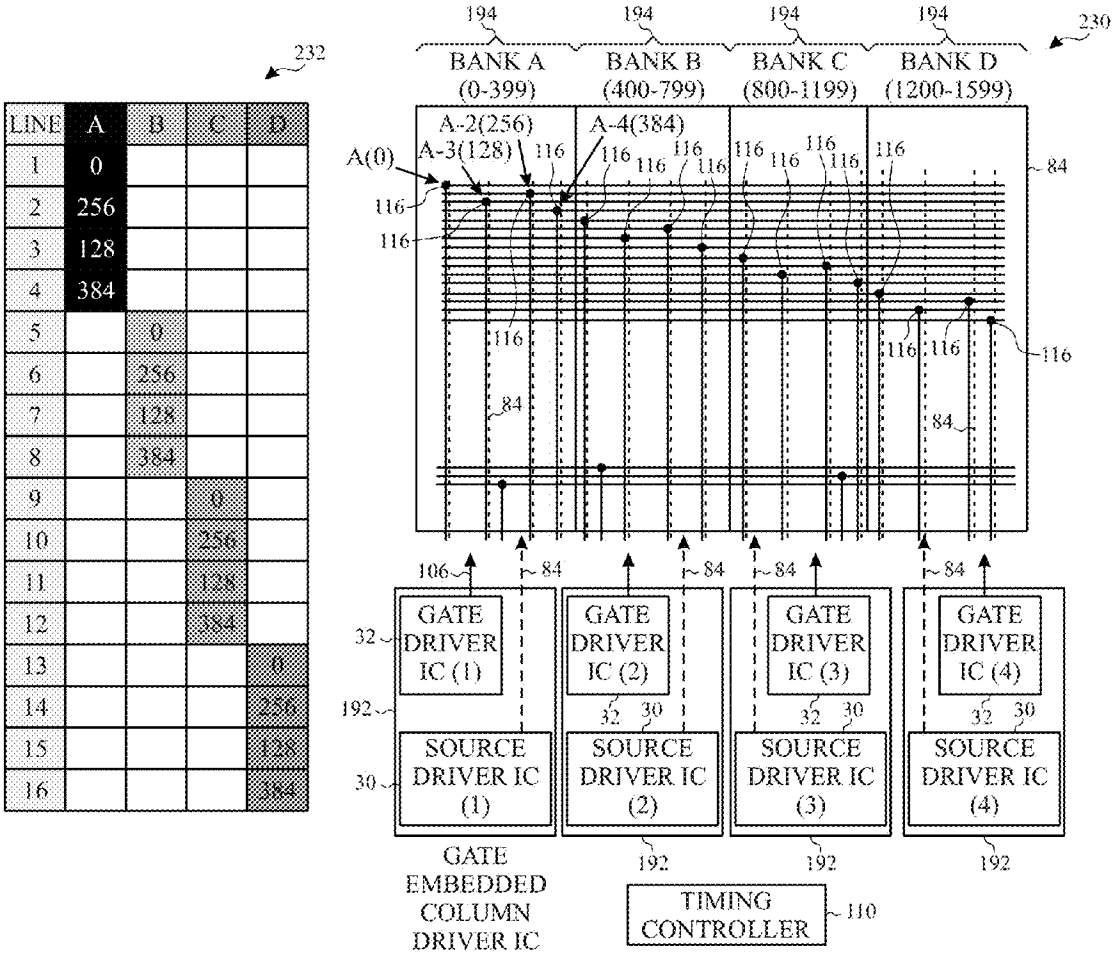
FIG. 18 illustrates four gate drive integrated circuits (ICs) that control the voltages provided to various gate lines of the display in the electronic device of FIG. 1 according to an interleaved pattern, in accordance with aspects of the present disclosure.

FIG. 18 illustrates yet another embodiment of a schematic diagram 230 for locations of the cross point nodes 116 along the panel 80. Like the schematic diagram 210 of FIG. 16 and the schematic diagram 220 of FIG. 17, the panel 80 of the schematic diagram 230 is divided into four equal banks 194. Also, the cross point nodes 116 of each bank 194 of pixels of the schematic diagram 220 may be positioned independently with respect to each other.

Referring to the schematic diagram 230, the cross point nodes 116 may be addressed using a subsection repetition scheme in which each cross point node 116 is addressed in order based on a reverse bit sequence number. For instance, referring to an address chart 232 depicted in FIG. 18, the address for each cross point node 116 may be selected successively for each gate line 86 for an individual bank 194. That is, the cross point node 116 for gate line 1 of bank A is located at x-coordinate 0, for gate line 2 of bank A is located at x-coordinate 256, for gate line 3 of bank A is located at x-coordinate 128, and for gate line 4 of bank A is located at x-coordinate 384. Since there are four banks 194 in the panel 80, the subsection repetition scheme involves using the same addressing pattern described above for each subsequent bank 194 but shifted down the number of banks 194 present in the panel. As such, the cross point node 116 for gate line 5 of bank B is located at x-coordinate 0, for gate line 6 of bank B is located at x-coordinate 256, for gate line 7 of bank B is located at x-coordinate 128, and for gate line 8 of bank B is located at x-coordinate 384.

This pattern is continuously repeated until each gate line 86 has a corresponding cross point node 116. The timing controller 110 may again be aware of this pattern via the information stored on the memory component and thus may drive each gate embedded column driver IC 192 according to the same pattern at different times. By using the repeatable pattern depicted in FIG. 18, similarly designed gate embedded column driver ICs 192 may be used to drive the pixels of each bank 194. These similarly gate embedded column driver ICs 192 may also be interchangeable with each other. Moreover, during operation, the gate embedded column driver ICs 192 may operate interleaved with each other.

In any case, the schematic diagrams illustrated in FIGS. 15-18 may be used to drive the pixels of the display 26 in an efficient manner by distributing the processing power consumed by each gate embedded column driver IC 192 across a number of ICs, as opposed to just one IC. Moreover, by employing multiple gate embedded column driver ICs 192, the driving scheme for pseudo randomly placed cross point nodes 116 may be more easily controlled and implemented using logic components since some of the logic is repeatable for each gate embedded column driver IC 192.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A display device, comprising:

a plurality of pixels;

a plurality of source lines configured to provide a plurality of data line signals to the plurality of pixels;

a plurality of gate lines configured to provide a plurality of gate signals to a plurality of switches associated with the plurality of pixels; and a plurality of voltage gate lines disposed parallel to the plurality of source lines and coupled to the plurality of gate lines at a plurality of cross point nodes, wherein the plurality of cross point nodes are positioned in a pseudo random order across the display device based on a bit sequence number that increments a most significant bit with respect to each gate line of the plurality of gate lines.

2. The display device of claim 1, wherein the plurality of cross point nodes are positioned to avoid forming a straight line edge comprising at least three of the plurality of cross point nodes.

3. The display device of claim 1, wherein a first coordinate of a first cross point node of the plurality of cross point nodes corresponds to a first gate line of the plurality of gate lines.

4. The display device of claim 3, wherein a second coordinate of the first cross point node of the plurality of cross point nodes corresponds to a decimal value of the bit sequence number.

5. The display device of claim 1, wherein adjacent cross point nodes of the plurality of cross point nodes are on opposite sides of the display device.

6. The display device of claim 1, comprising a gate driver integrated circuit (IC) configured to send a plurality of gate signals to the plurality of pixels via the plurality of voltage gate lines based on a plurality of positions of the plurality of cross point nodes.

7. A system, comprising:

a display comprising a plurality of pixels, wherein the display is configured to render image data;

a plurality of gate lines configured to couple to the plurality of pixels;

a plurality of source lines configured to couple to the plurality of pixels, wherein the plurality of source lines are perpendicular to the plurality of gate lines;

a plurality of voltage gate lines configured to couple to the plurality of gate lines, wherein the plurality of voltage gate lines are parallel to the plurality of source lines;

a plurality of cross point nodes configured to electrically couple the plurality of gate lines to the plurality of voltage gate lines, wherein the plurality of cross point nodes are positioned in a pseudo random order across the display;

a plurality of gate driver integrated circuits (ICs) configured to provide a plurality of gate signals values to the plurality of pixels via the plurality of cross point nodes;

a plurality of gate embedded column driver integrated circuits (ICs) comprising the plurality of gate driver ICs, wherein the plurality of gate embedded column driver ICs comprise a plurality of source driver integrated circuits (ICs) configured to send a plurality of pixel values to the plurality of pixels via the plurality of source lines; and a timing controller configured to coordinate when each of the plurality of gate embedded column driver ICs sends the plurality of pixel values and the plurality of gate signal values to the plurality of pixels based on a plurality of positions of the plurality of cross point nodes.

8. The system of claim 7, wherein the each of the plurality of gate driver ICs is configured to drive a portion of the plurality of pixels.

9. The system of claim 7, comprising a memory component comprising information regarding the plurality of positions of the plurality of cross point nodes.

10. A display panel, comprising:

a plurality of pixels, wherein a first and a second distinct portion of the plurality of pixels are associated with a first and a second bank of pixels;

a plurality of source lines configured to provide a plurality of data line signals to the plurality of pixels;

a plurality of gate lines configured to provide a plurality of gate signals to a plurality of switches associated with the plurality of pixels;

a plurality of voltage gate lines disposed parallel to the plurality of source lines; and a plurality of cross point nodes configured to electrically couple the plurality of voltage gate lines to the plurality of gate lines, wherein a first and a second distinct portion of the plurality of cross point nodes are associated with the first and the second bank of pixels, and wherein each of the first and the second distinct portion of the plurality of cross point nodes are positioned in a pseudo random order, wherein a first pattern of positions associated with the first distinct portion of the plurality of cross point nodes is the same as a second pattern of positions associated with the second distinct portion of the plurality of cross point nodes, and wherein the pseudo random order comprises a list of values, wherein each cross point node of the plurality of cross point nodes is assigned a value from the list in a round robin manner based on the first and second banks.

11. The display panel of claim 10, wherein the first pattern of positions begins at a first gate line of the plurality of gate lines and the second pattern of positions begins at a second gate line of the plurality of gate lines.

12. The display panel of claim 11, wherein the first gate line and the second gate line are adjacent to each other.

13. The display panel of claim 11, wherein the first gate line and the second gate line are separated by a number of banks of pixels associated with the display panel.

14. The display panel of claim 10, wherein the list of values are determined based on incrementing a bit sequence value by a most significant bit.

* * * * *